US010002737B2

(12) United States Patent
von zur Muehlen

(10) Patent No.: US 10,002,737 B2
(45) Date of Patent: Jun. 19, 2018

(54) FUSE MODULE AND FUSIBLE DISCONNECT SWITCH ASSEMBLY THEREFOR

(71) Applicant: EATON INTELLIGENT POWER LIMITED, Dublin (IE)

(72) Inventor: Patrick Alexander von zur Muehlen, Wildwood, MO (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days. days.

(21) Appl. No.: 15/168,707

(22) Filed: May 31, 2016

(65) Prior Publication Data

US 2017/0345607 A1 Nov. 30, 2017

(51) Int. Cl.

| | |
|---|---|
| ***H01H 85/48*** | (2006.01) |
| ***H01H 9/10*** | (2006.01) |
| ***H01H 21/06*** | (2006.01) |
| ***H01H 21/16*** | (2006.01) |
| ***H01H 85/042*** | (2006.01) |
| ***H01H 85/045*** | (2006.01) |
| ***H01H 85/54*** | (2006.01) |
| ***H01H 85/56*** | (2006.01) |

(52) U.S. Cl.

CPC ..... *H01H 85/48* (2013.01); *H01H 9/10* (2013.01); *H01H 21/06* (2013.01); *H01H 21/165* (2013.01); *H01H 85/042* (2013.01); *H01H 85/0452* (2013.01); *H01H 85/54* (2013.01); *H01H 85/56* (2013.01); *H01H 2207/022* (2013.01)

(58) Field of Classification Search

CPC ..... H01H 85/48; H01H 21/06; H01H 9/10; H01H 21/165; H01H 2207/022

USPC ..... 337/255

See application file for complete search history.

(56) References Cited

U.S. PATENT DOCUMENTS

| | | | | |
|---|---|---|---|---|
| 2,186,813 | A * | 1/1940 | Adam | H01H 9/102 337/194 |
| 5,841,337 | A | 11/1998 | Douglass | |
| 6,194,989 | B1 * | 2/2001 | Douglass | H01H 85/10 337/228 |
| 6,531,948 | B1 | 3/2003 | Mennell | |
| 6,696,969 | B2 * | 2/2004 | Torrez | H01H 85/306 340/638 |
| 9,697,976 | B2 * | 7/2017 | Katarki | H01H 85/12 |
| 2003/0020589 | A1 | 1/2003 | Scoggin | |
| 2011/0176258 | A1 | 7/2011 | Creighton et al. | |
| 2016/0276123 | A1 * | 9/2016 | Katarki | H01H 85/12 |
| 2016/0336137 | A1 * | 11/2016 | Katarki | H01H 85/12 |

OTHER PUBLICATIONS

International Search Report and Written Opinion for International Application No. PCT/US2017/029560, Jul. 6, 2017, 15 pages.

* cited by examiner

*Primary Examiner* — Anatoly Vortman

(74) *Attorney, Agent, or Firm* — Armstrong Teasdale LLP

(57) ABSTRACT

An embodiment of a fuse module has been disclosed. The fuse module includes a housing, a fuse element unit disposed within the housing, and a pair of terminal blades between which the fuse element unit is electrically connected. Each terminal blade has a pair of connection portions.

11 Claims, 5 Drawing Sheets

FUSE MODULE AND FUSIBLE DISCONNECT SWITCH ASSEMBLY THEREFOR

BACKGROUND

The field of the invention relates generally to electrical fuses and, more specifically, to higher-ampacity fuses and associated accessories that are made in a more cost-effective manner.

Fuses are widely used as overcurrent protection devices to prevent costly damage to electrical circuits. Fuse terminals typically form an electrical connection between an electrical power source or power supply and an electrical component or a combination of components arranged in an electrical circuit. One or more fusible links or elements, or a fuse element assembly, is connected between the fuse terminals, so that when electrical current flowing through the fuse exceeds a predetermined limit, the fusible elements melt and open one or more circuits through the fuse to prevent electrical component damage. In that regard, conventional fuses are typically designated with ampacity ratings that are indicative of their predetermined current limits. For example, some fuses have lower ampacity ratings (e.g., ampacity ratings of 600 A, 400 A, 200 A, or lower), while other fuses have higher ampacity ratings (e.g., an ampacity rating of 1200 A or higher). By comparison, lower-ampacity fuses tend to be more widely used and, thus, tend to have a greater demand in the market.

Because higher-ampacity fuses are generally made with larger fuse elements than lower-ampacity fuses, higher-ampacity fuses are generally made with larger housings and/or terminals as well. The accessories (e.g., fuse holders) for lower-ampacity fuses thus tend to be incompatible with higher-ampacity fuses, and vice versa. As a result, lower-ampacity fuses and higher-ampacity fuses are often provided with their own specially-designed accessories. However, given that higher-ampacity fuses have less market demand than lower-ampacity fuses, it can be cost-prohibitive to make higher-ampacity fuses with specially-designed accessories. To facilitate making higher-ampacity fuses and their accessories in a more cost-effective manner, it would be useful to design higher-ampacity fuses and accessories that can be made with minimal modification to the hardware of lower-ampacity fuses and their accessories.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION

Exemplary embodiments of electrical fuses and accessories are described below. Method aspects will be in part apparent and in part explicitly discussed in the description.

Figure 1:
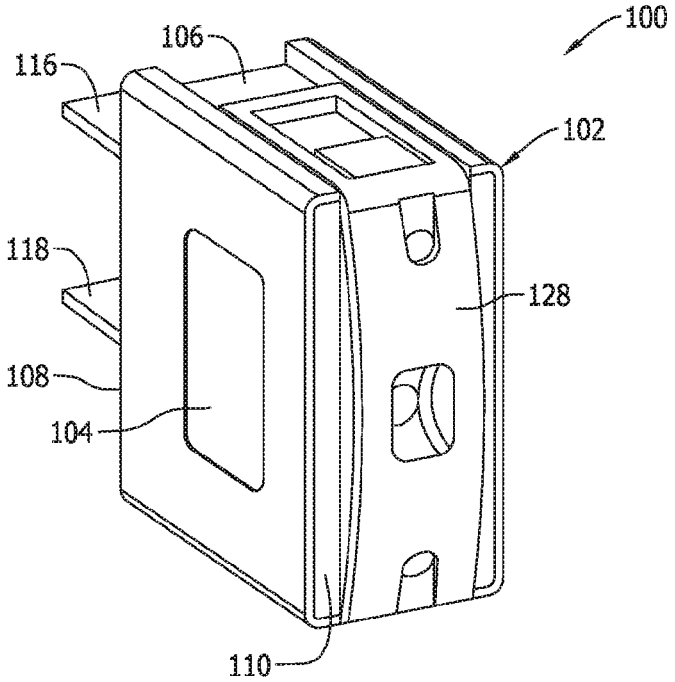
FIG. 1 is a perspective view of a fuse module having a lower ampacity rating.
Figure 2:
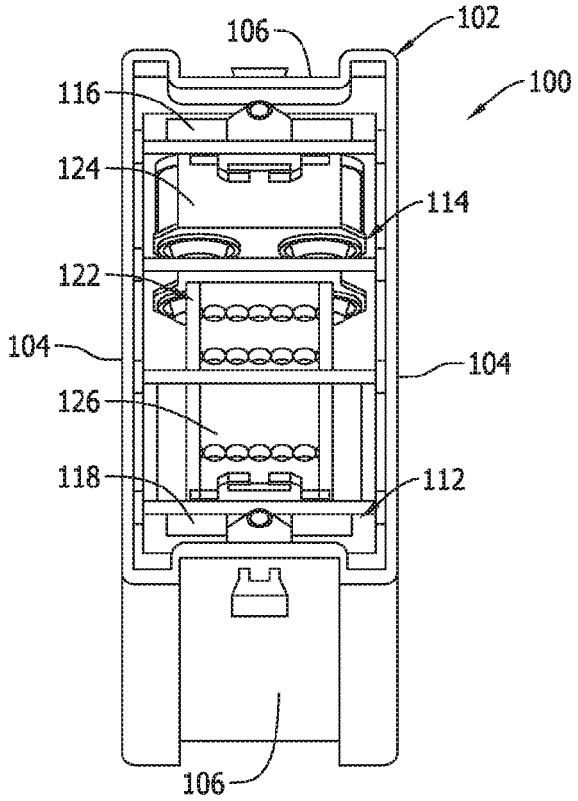
FIG. 2 is a cross-sectional view of the fuse module shown in FIG. 1.

With reference to FIGS. 1 and 2, the illustrated fuse module 100 is similar in some respects to the finger-safe, dual-element, time-delay CUBEFuse™ power fuse modules (Catalog Nos. TCF_ or TCF_RN, Datasheet No. 9000) commercially available from Bussmann by Eaton of St. Louis, Mo. The fuse module 100 includes a fuse housing 102 that is fabricated from an electrically nonconductive or insulative material such as, for example, a plastic material. In one particular embodiment, the fuse housing 102 may be fabricated from a thermoplastic material such that the fuse housing 102 exhibits enhanced heat/pressure containment properties at a reduced cost of manufacture as compared to other suitable materials such as ceramic, glass-melamine composite, or thermoset plastic materials.

The fuse housing 102 has a generally hexahedronal (or cube-type) shape. In the illustrated embodiment, for instance, the fuse housing 102 has a substantially rectangular cuboid shape with opposed major side walls 104 and opposed minor side walls 106 interconnecting, and arranged orthogonally with respect to, the major side walls 104. The fuse housing 102 further includes a bottom wall 108 and a top wall 110 such that the walls 104, 106, 108, 110 collectively define a closed cavity 112. Alternatively, the fuse housing 102 may have any suitable arrangement of walls that facilitates enabling the fuse module 100 to function as described herein (e.g., the fuse housing 102 may have a single, annular wall forming a generally cylindrical shape in other embodiments).

The illustrated fuse module 100 further includes a fuse element assembly 114 completely contained within the cavity 112 of the fuse housing 102 and connected between a pair of terminal blades, namely a first terminal blade 116 and a second terminal blade 118. The terminal blades 116, 118 are fabricated from a conductive material, and the terminal blades 116, 118 project from the bottom wall 108 in spaced-apart, generally parallel planes. Other suitable arrangements of the terminal blades 116, 118 are also contemplated. For example, one of the terminal blades 116, 118 could be oriented substantially perpendicular to the other, or one of the terminal blades 116, 118 could be staggered or offset relative to the other.

The fuse element assembly 114 is electrically connected between the terminal blades 116, 118 within the cavity 112 to provide a current path between the terminal blades 116, 118. Notably, the fuse element assembly 114 is designed to melt, disintegrate, or otherwise structurally fail in response to predefined electrical overcurrent conditions and/or short-circuit conditions, thereby permanently opening the current path between the terminal blades 116, 118. When the fuse element assembly 114 opens the current path, load side circuitry (not shown) can be electrically isolated from line side circuitry (not shown) through the fuse module 100 to prevent damage to the load side circuitry and associated componentry. After having opened in this manner, the fuse module 100 may need to be removed and replaced to restore the electrical connection between the load side circuitry and the line side circuitry.

The fuse element assembly 114 includes at least one fuse element unit 122 that is said to be of a "dual-element" configuration in the sense that it includes at least two different types of fuse elements arranged in-series with one another, namely a first type that performs a time-delay overcurrent protection function and a second type that performs a short-circuit protection function. In that regard, each illustrated fuse element unit 122 includes at least one overcurrent protection element (in the form of a trigger mechanism 124) and at least one short-circuit protection element (in the form of a perforated strip 126). Of each fuse element unit 122, the trigger mechanism(s) 124 are electrically connected to the first terminal blade 116; and the perforated strip(s) 126 are electrically connected to, and extend between, the trigger mechanism(s) 124 and the second terminal blade 118. In this manner, each fuse element unit 122 spans from the first terminal blade 116 to the second terminal blade 118 within the cavity 112 to provide the current path between the first terminal blade 116 and the second terminal blade 118. Notably, as a result of the construction of the terminals 116, 118 and the fuse element assembly 114 therebetween, the fuse module 100 has been given a lower ampacity rating such as, for example, an ampacity rating of 600 A.

Figure 3:
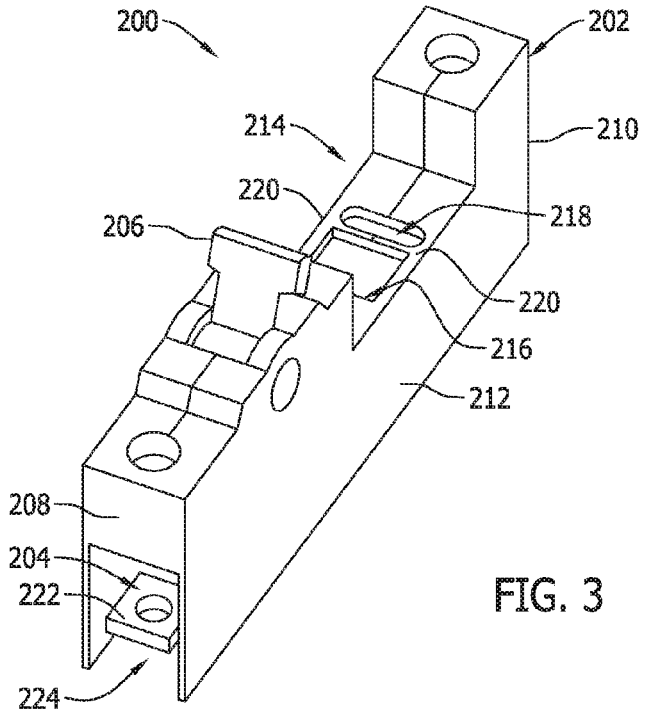
FIG. 3 is a perspective view of a fusible disconnect switch for use with the fuse module shown in FIG. 1.
Figure 4:
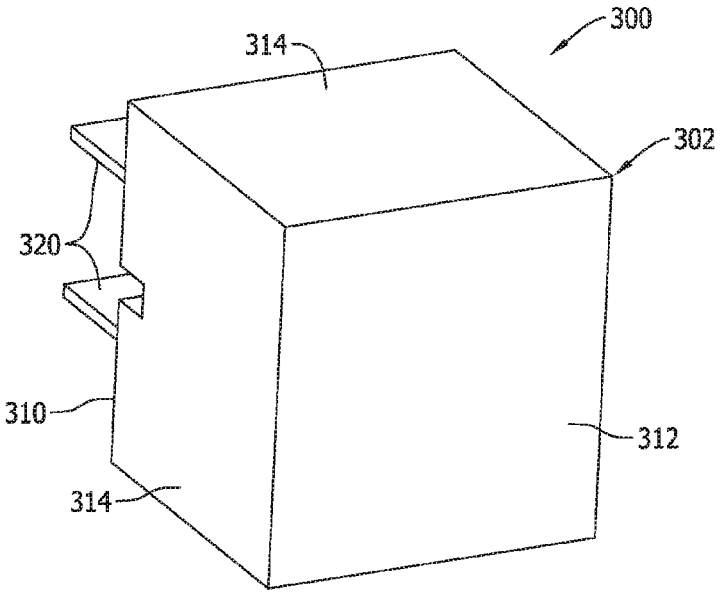
FIG. 4 is a perspective view of a fuse module having a higher ampacity rating.
Figure 5:
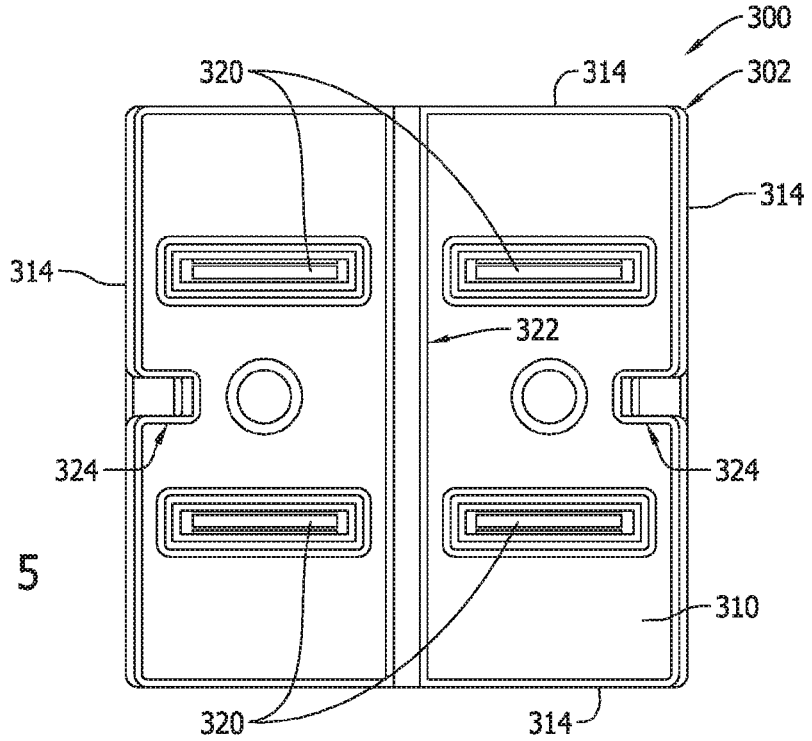
FIG. 5 is a bottom view of the fuse module shown in FIG. 4.
Figure 6:
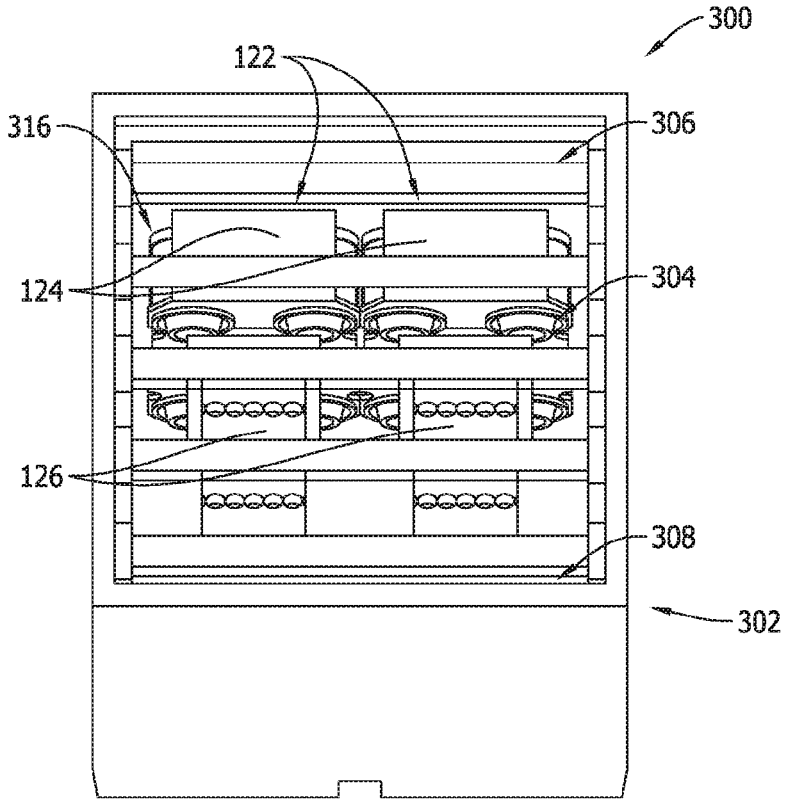
FIG. 6 is a cross-sectional view of the fuse module shown in FIG. 4.
Figure 7:
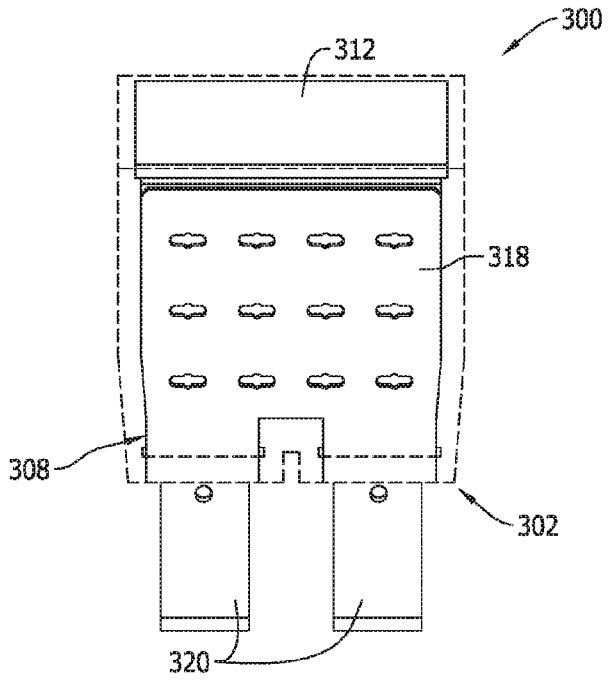
FIG. 7 is a side view of the fuse module shown in FIG. 4 with a housing wall of the fuse module made transparent.

With reference now to FIG. 3, an embodiment of a fusible disconnect switch 200 (broadly a fuse holder or compact circuit protector) is illustrated. The switch 200 is designed to establish an electrical connection between line side circuitry and load side circuitry through the fuse module 100. The switch 200 is rather compact and is sized to occupy less space in an associated fusible panel assembly, for example, than could otherwise have been accomplished using conventional in-line fuse and circuit breaker combinations. In particular, the fuse module 100 set forth herein occupies a smaller area (sometimes referred to as a footprint) than other types of fuses of comparable rating and interruption capability. With this compact design, the switch 200 can likewise be made with a more compact design, such that the switch 200 and the fuse module 100 collectively facilitate reducing the size of the associated panel assembly while also providing enhanced interruption capabilities.

The switch 200 includes a non-conductive switch housing 202, a pole assembly 204 contained in part within the housing 202, and an actuator 206 mounted to the housing 202 in operable connection with the pole assembly 204. The housing 202 has a first end 208, a second end 210, and a body 212 extending between the first end 208 and the second end 210. The body 212 has a receptacle 214 in which a first blade slot 216 and a second blade slot 218 of the pole assembly 204 are accessible. The receptacle 214 is bounded on its sides by a pair of opposing lips 220, and the receptacle 214 is sized to receive at least a portion of the fuse module 100 therein, such that the terminal blades 116, 118 of the fuse module 100 are inserted into the respective blade slots 216, 218 for electrically connecting the fuse module 100 to the line side circuitry and the load side circuitry via the pole assembly 204 of the switch 200.

A first pole terminal 222 of the pole assembly 204 is electrically connected to the first blade slot 216 and is accessible via a first compartment 224 at the first end 208 of the housing 202. Similarly, a second pole terminal (not shown) of the pole assembly 204 is electrically connected to the second blade slot 218 and is accessible via a second compartment (not shown) at the second end 210 of the housing 202. As such, by electrically connecting line side circuitry to the first pole terminal 222, and load side circuitry to the second pole terminal, electrical current can be selectively supplied from the line side circuitry to the load side circuitry via the pole assembly 204 when the fuse module 100 is installed in the receptacle 214. More specifically, by manually pivoting the actuator 206 of the switch 200 between an open position and a closed position when the fuse module 100 is installed in the receptacle 214, the fuse module 100 and the load side circuitry can be selectively connected to, or disconnected from, the line side circuitry as desired, while the line side circuitry remains "live" in full power operation. In this manner, the switch 200 is useful for electrically isolating the load side circuitry for maintenance, or for removing the fuse module 100 for replacement.

Notably, when the fuse module 100 is installed in the receptacle 214, the current-conducting components of the fuse module 100 (e.g., the terminal blades 116, 118) are physically isolated from the user such that the fuse module 100 is said to be "finger-safe" in the illustrated embodiment. In other words, the fuse module 100 may be safely handled during insertion into the receptacle 214 or removal from the receptacle 214 with less risk of electrical shock. More specifically, the fuse module 100 is designed for easy and safe insertion into, and removal from, the receptacle 214 by hand without tools. For example, as shown in FIG. 1, the fuse module 100 may optionally be provided with a selectively deployable handle 128 for ease in gripping the fuse module 100 during removal from the receptacle 214. As such, when the fuse module 100 is installed in the receptacle 214, the fuse module 100 projects from the switch housing 202 and is accessible for grasping by hand to pull and fully disengage the fuse module 100 from the line side circuitry and load side circuitry, and to completely remove the fuse module 100 from the receptacle 214 of the switch housing 202. Likewise, a replacement fuse module 100 may be grasped by hand and inserted into the receptacle 214 of the switch housing 202 to engage the replacement fuse module 100 with the line and load side circuitry. Such plug-in connection and disconnection of the fuse module 100 advantageously facilitates quick and convenient installation and removal of the fuse module 100 without requiring separately supplied fuse carrier elements and without requiring tools or fasteners common to other known disconnect devices. Alternatively, the fuse module 100 and the switch housing 202 may be designed for insertion, installed disposition, and removal of the fuse module 100 in any suitable manner.

While the fuse module 100 may be used in combination with the illustrated switch 200 in some embodiments, it should be noted that the manual switching aspects associated with the illustrated switch 200 (e.g., the presence of the pivotable actuator 206 on the switch housing 202) may be considered optional and may be omitted, in which case the switch 200 could simply function as a more simplified fuse holder for the fuse module 100. It is understood, however, that even if the switch 200 was to be designed as a fuse holder in this manner, the circuit through the fuse holder would still be switchable by mere insertion and removal of the fuse module 100 from the receptacle 214. That is, when used with such a fuse holder, the fuse module 100 would still provide a mode of switching the circuit, and the combination of the fuse holder and the fuse module 100 would nonetheless function in the manner of a disconnect switch. Alternatively, the fuse module 100 may be used in conjunction with any suitable switching mechanism having any suitable mode of operation that is or is not independent from the pluggable switching mode of a more simplified version of the illustrated switch 200.

With its lower ampacity rating (of, for example, 600 A), the fuse module 100 is useful in many common applications, and the market demand for the fuse module 100 is relatively high as a result. However, there are some applications for which fuse modules of higher ampacity ratings (e.g., an ampacity rating of 1200 A) are useful. However, because the market demand for higher-ampacity fuse modules is relatively low (especially when compared to that of lower-ampacity fuse modules such as fuse module 100), it can be cost prohibitive to design and produce higher-ampacity fuse modules and associated accessories (e.g., fusible disconnect switches). It would be useful, therefore, to make higher-ampacity fuse modules and accessories using the hardware of lower-ampacity fuse modules and accessories. For example, it would be useful to make a higher-ampacity fuse module and its associated fusible disconnect switch using the designs of fuse module 100 and switch 200, with minimal changes thereto. Set forth below are embodiments of such higher-ampacity fuse modules, associated accessories, and methods of fabrication that facilitate this objective.

FIGS. 4-7 are various views of a fuse module 300 having a higher ampacity rating than the fuse module 100. The fuse module 300 is designed in a manner that essentially combines multiple of the lower-ampacity fuse modules 100 together to form a single, higher-ampacity fuse module, with minimal changes to the design of the combined-together, lower-ampacity fuse modules 100 as set forth in more detail below. More specifically, the fuse module 300 is designed to have an ampacity rating that is a multiple of (e.g., two-times, three-times, four-times, five-times, etc.) the ampacity rating of the fuse module 100. For example, if the fuse module 100 has an ampacity rating of 600 A, then the fuse module 300 may be constructed, in the manner described below, to have an ampacity rating of 1200 A (i.e., two-times the ampacity rating of the fuse module 100). Notably, the fuse module 300 is not limited to having an ampacity rating of 1200 A but, rather, the fuse module 300 may have any suitable ampacity rating in other embodiments (e.g., the fuse module 300 may have an ampacity rating of less than 1200 A in some embodiments, or may have an ampacity rating of more than 1200 A in other embodiments).

The fuse module 300 includes a housing 302, a fuse element assembly 304 disposed within the housing 302, and a pair of terminals blades electrically connected to the fuse element assembly 304, namely a first terminal blade 306 and a second terminal blade 308. The housing 302 has a generally hexahedronal (or cube-type) shape. In the illustrated embodiment, for instance, the housing 302 has a substantially square cuboid shape that occupies substantially the same amount of space as a pair of the housings 102 arranged side-by-side. The housing 302 has a bottom wall 310, a top wall 312, and a plurality of sidewalls 314 such that the walls 310, 312, 314 collectively define a closed cavity 316 in which the fuse element assembly 304 is contained. Alternatively, the housing 302 may have any suitable arrangement of walls that facilitates enabling the fuse module 300 to function as described herein (e.g., the housing 302 may have a single, annular wall forming a generally cylindrical shape in other embodiments).

Each illustrated terminal blade 306, 308 has a main portion 318 and a pair of connection portions 320 integrally formed together with the main portion 318 such that the connection portions 320 extend from the main portion 318 in substantially parallel and coplanar relation. The main portion 318 is contained within the cavity 316 of the housing 302, and the connection portions 320 extend through the bottom wall 310 of the housing 302, such that the connection portions 320 are exposed outside of the housing 302. The terminal blades 306, 308 are arranged such that the main portion 318 of the first terminal blade 306 is oriented substantially parallel with the main portion 318 of the second terminal blade 308 inside the cavity 316 of the housing 302. As such, the connection portions 320 of the first terminal blade 306 are likewise oriented substantially parallel with the connection portions 320 of the second terminal blade 308 outside the cavity 316 of the housing 302.

Moreover, the illustrated fuse element assembly 304 includes a plurality of the fuse element units 122, each of which is designed for use in a fuse module 100. The fuse element units 122 are electrically connected in parallel between the main portions 318 of the terminals blades 306, 308, such that the fuse element units 122 share each terminal blade 306, 308. More specifically, the trigger mechanism 124 of each fuse element unit 122 is electrically connected to the main portion 318 of the first terminal blade 306, and the perforated strip 126 of each fuse element unit 122 is electrically connected to the main portion 318 of the second terminal blade 308. As such, the trigger mechanisms 124 of the various fuse element units 122 are arranged side-by-side at the main portion 318 of the first terminal blade 306, and the perforated strips 126 of the various fuse element units 122 are arranged side-by-side at the main portion 318 of the second terminal blade 308.

Figure 8:
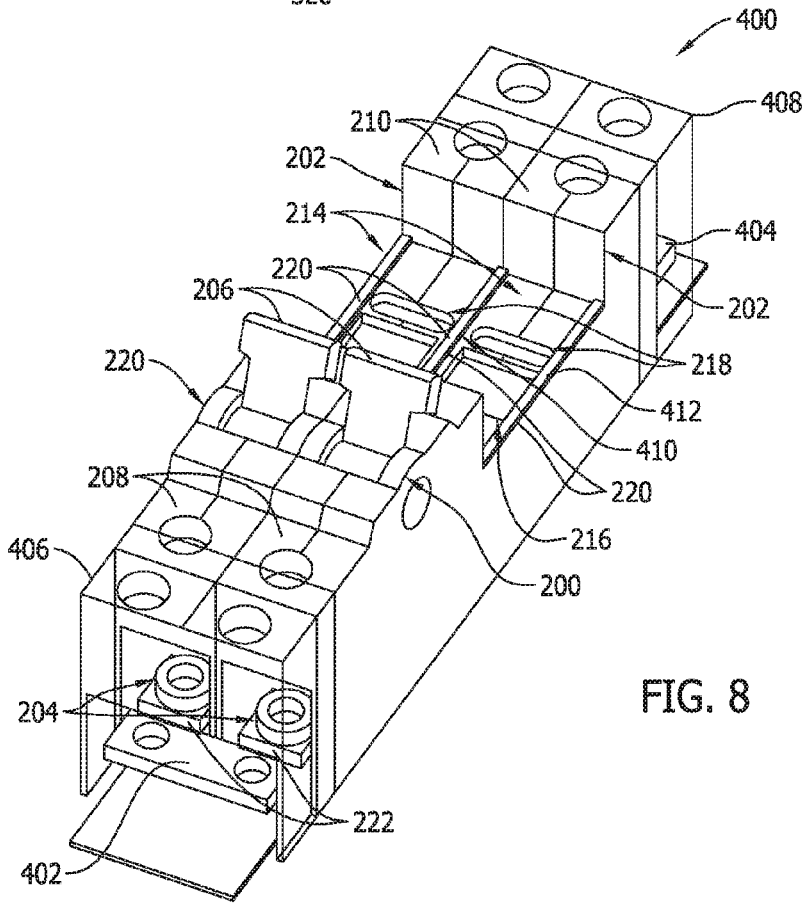
FIG. 8 is a perspective view of a fusible disconnect switch assembly for use with the fuse module shown in FIG. 4.

The illustrated fuse module 300 is designed for use with combined-together accessories of the fuse module 100, with minimal changes made to the hardware design thereof. For example, with reference to FIG. 8, the fuse module 300 is designed for use with a fusible disconnect switch assembly 400 made from a plurality of the disconnect switches 200 that have been ganged together. More specifically, the illustrated disconnect switch assembly 400 includes a pair of disconnect switches 200 that are arranged side-by-side, with their first pole terminals 222 electrically connected together via a first tie bar 402, and their second pole terminals (not shown) electrically connected via a second tie bar 404. The first tie bar 402 is at least partially contained within a first hood 406 coupled to the first ends 208 of the respective housings 202, and the second tie bar 404 is at least partially contained within a second hood 408 coupled to the second ends 210 of the respective housings 202. The pole assemblies 204 of the respective disconnect switches 200 are thus connected electrically in parallel between the tie bars 402, 404.

With the receptacles 214 of the housings 202 arranged side-by-side, the actuators 206 of the switches 200 are also arranged side-by-side, and adjacent lips 220 of the housings 202 are likewise arranged side-by-side to collectively define a lengthwise rib 410 that partially separates the receptacles 214. In this manner, the first blade slots 216 of the switches 200 are aligned (e.g., are substantially coplanar) across the rib 410, and the second blade slots 218 of the switches 200 are likewise aligned (e.g., are substantially coplanar) across the rib 410. Referring back to FIG. 5, to facilitate installing the fuse module 300 on the switch assembly 400, the housing 302 is designed to span the receptacles 214 across the rib 410, and the bottom wall 310 and the sidewalls 314 of the housing 302 are thus contoured to collectively define a groove 322 sized to receive the rib 410. The fuse module 300 can thus be installed on the disconnect switch assembly 400 by inserting the connection portions 320 of the first terminal bade 306 into the aligned first blade slots 216 of the switch assembly 400, and by inserting the connection portions 320 of the second terminal blade 308 into the aligned second blade slots 218 of the switch assembly 400.

Notably, at least one tab 412 is coupled to, or integrally formed together with, one of the lips 220 that is opposite the rib 410 such that the tab(s) 412 serve as protruding-type rejection features which ensure that recommended fuse module combinations are installed on the switch assembly 400, as set forth in more detail below. Referring again to FIG. 5, the bottom wall 310 and sidewalls 314 of the housing 302 are contoured to collectively define a pair of opposed notches 324 each sized to receive a tab 412. Thus, the fuse module 300 is installed on the switch assembly 400 by inserting the connection portions 320 of the fuse module 300 into their respective blade slots 216, 218, and by seating the housing 302 within the receptacles 214 such that the rib 410 is received in the groove 322. Notably, because the fuse module 300 has two opposed notches 324, the fuse module 300 can be installed in one of two orientations that are one hundred and eighty degrees apart (i.e., in a first orientation of the fuse module 300, one of the notches 324 receives the tab 412; and, in a second orientation of the fuse module 300, the other of the notches 324 receives the tab 412).

When the fuse module 300 is installed on the switch assembly 400 as set forth above, line side circuitry can be electrically connected to the first tie bar 402, and load side circuitry can be electrically connected to the second tie bar 404. Electrical current can thus flow across the first tie bar 402 and into the pole assemblies 204 via the respective first pole terminals 222, such that the current diverges from the first tie bar 402 and flows in parallel across the pole assemblies 204 toward the first blade slots 216 and into the fuse module 300. At the fuse module 300, the current converges and collectively flows through the main portion 318 of the first terminal blade 306, then diverging to flow across the parallel fuse element units 122, again converging to flow through the main portion 318 of the second terminal blade 308. The current again diverges into the second blade slots 218 and flows in parallel across the remainder of the pole assemblies 204 toward the respective second pole terminals (not shown), converging at the second tie bar 404 and flowing toward the load side circuitry therefrom. By pivoting the actuators 206 (which can be coupled together for pivoting in unison), the supply of electrical current from the line side circuitry to the fuse module 300 (and the load side circuitry), can be regulated as desired.

Notably, because each switch assembly 400 has a plurality of disconnect switches 200 that are ganged together and, hence, has a plurality of side-by-side receptacles 214, the lower-ampacity fuse module 100 can be installed on the switch assembly 400 in one of the receptacles 214 (i.e., the receptacle 214 not having the tab 412), rather than installing the fuse module 300 which spans both receptacles 214. As such, the switch assembly 400 enables a user to down-fuse as desired. However, because the tab 412 is located at least partially within one of the receptacles 214, the user is prevented from installing two lower-ampacity fuse modules 100 on the switch assembly 400 (i.e., the user cannot install a fuse module 100 in both receptacles 214), because the fuse modules 100 do not have a corresponding notch sized to receive the tab 412. The switch assembly 400 thus enables down-fuse applications, but restricts the down-fuse applications to utilizing only one lower-ampacity fuse module 100 at a time.

Figure 9:
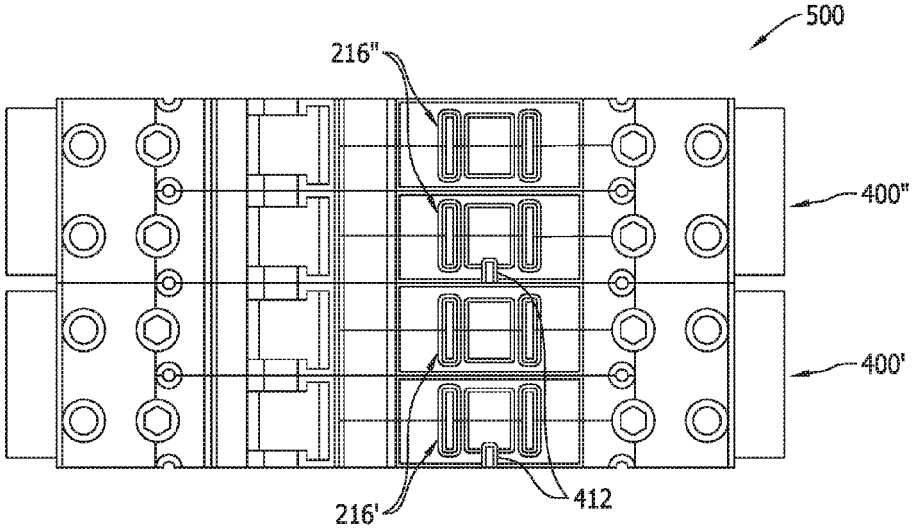
FIG. 9 is a top view of a fusible panel assembly having multiple of the fusible disconnect switch assemblies shown in FIG. 8.
Figure 10:
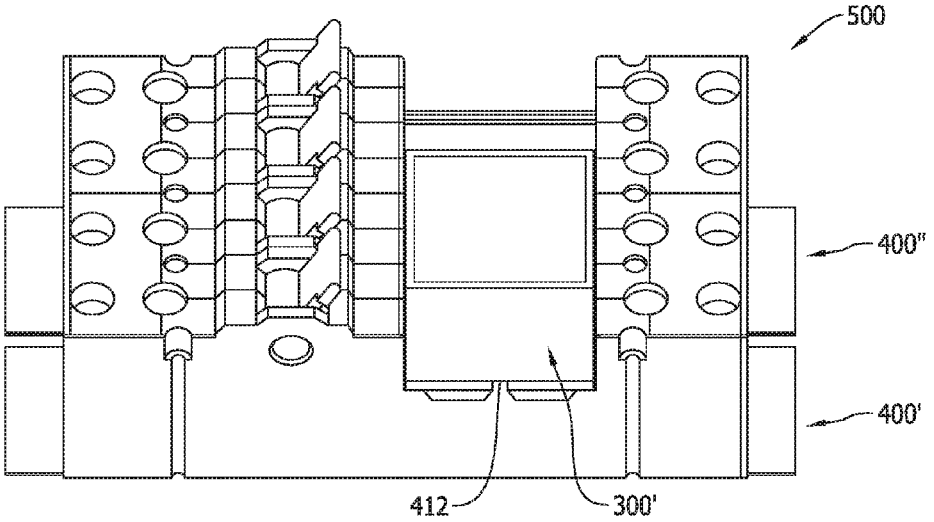
FIG. 10 is a perspective view of the fusible panel assembly shown in FIG. 9 with the fuse module of FIG. 4 installed thereon.

Moreover, a plurality of the switch assemblies 400 can be coupled together side-by-side in a fusible panel assembly 500 as desired. For example, as shown in FIGS. 9 and 10, a first fusible disconnect switch assembly 400' and a second fusible disconnect switch assembly 400" can be arranged side-by-side. In such a configuration, each such switch assembly 400 can receive its own respective lower-ampacity fuse module 100 or its own respective higher-ampacity fuse module 300 (e.g., a first fuse module 300' can be installed in the first fusible disconnect switch assembly 400' as shown in FIG. 10, and a second fuse module (not shown) can be installed in the second fusible disconnect switch assembly 400"). However, because each such switch assembly 400 has its own tab 412 (e.g., because the tab 412 of the second fusible disconnect switch assembly 400" is adjacent the first fusible disconnect switch assembly 400'), the user is prevented from installing a fuse module 300 across (or spanning) the switch assemblies 400', 400". In other words, a user cannot install a fuse module 300 with one connection portion 320 of the first terminal blade 306 inserted into a first blade slot 216' of the first switch assembly 400', and with the other connection portion 320 of the first terminal blade 306 inserted into a first blade slot 216" of the second switch assembly 400". Although the switch assemblies 400 of the panel assembly 500 are not electrically connected together in the illustrated embodiment (i.e., each switch assembly 400 is connectable to a different line side circuit and/or load side circuit in the illustrated embodiment), the switch assemblies 400 may be electrically connected together in other embodiments (i.e., the switch assemblies 400 may be connectable to the same line side circuit and/or load side circuit in other embodiments).

By making higher-ampacity fuse modules and accessories (e.g., fusible disconnect switch assemblies) using the hardware of lower-ampacity fuse modules and accessories (e.g., fusible disconnect switches), with minimal modifications thereto in the manner described above, the costs associated with designing and manufacturing higher-ampacity fuse modules and accessories can be reduced, and the compatibility of higher-ampacity fuse modules and accessories with lower-ampacity fuse modules and accessories can be enhanced.

The benefits of the inventive concepts described are now believed to have been amply illustrated in relation to the exemplary embodiments disclosed.

An embodiment of a fuse module has been disclosed. The fuse module includes a housing, a fuse element unit disposed within the housing, and a pair of terminal blades between which the fuse element unit is electrically connected. Each terminal blade has a pair of connection portions.

Optionally, the housing may have a substantially square cuboid shape. Each terminal blade may have a main portion from which the associated connection portions extend. Also, the connection portions may extend through the housing. The fuse element unit may have a dual-element configuration. The fuse element unit may have at least one trigger mechanism and at least one perforated strip electrically connected to the trigger mechanism. Additionally, the fuse module may have an ampacity rating of at least 1200 A.

An embodiment a fusible disconnect switch assembly has also been disclosed. The fusible disconnect switch assembly includes a first fusible disconnect switch having a pole terminal, and a second fusible disconnect switch having a pole terminal. The fusible disconnect switch assembly further includes a tie bar electrically connecting the pole terminals.

Optionally, each fusible disconnect switch may have a housing, and the housings may be arranged side-by-side. Each housing may have a receptacle defined in part by a lip, and the lips may be arranged side-by-side to define a rib between the receptacles. Each housing may have a receptacle, and only one of the housings may have a rejection feature adjacent its associated receptacle. The rejection feature may be a protruding-type rejection feature. Furthermore, each fusible disconnect switch may have a pivotable actuator. Each fusible disconnect switch may include a second pole terminal, and the assembly may include a second tie bar electrically connecting the second pole terminals together. Additionally, each fusible disconnect switch may have a blade slot, and the blade slots may be aligned to receive a fuse module that spans the fusible disconnect switches.

An embodiment of a fusible panel assembly has also been disclosed. The fusible panel assembly includes a first fusible disconnect switch assembly having a pair of disconnect switches arranged side-by-side and electrically connected together. The fusible panel assembly also includes a second fusible disconnect switch assembly having a pair of disconnect switches arranged side-by-side and electrically connected together.

Optionally, the first fusible disconnect switch assembly and the second fusible disconnect switch assembly may be arranged side-by-side. The first fusible disconnect switch assembly may not be electrically connected to the second fusible disconnect switch assembly. Furthermore, the disconnect switches of each fusible disconnect switch assembly may be electrically connected together by a tie rod. Additionally, each fusible disconnect switch may have a housing defining a receptacle, and only one housing of each fusible disconnect switch assembly may have a rejection feature at its associated receptacle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A fusible disconnect switch assembly comprising:

a fuse module comprising:

a fuse module housing;

a fuse element unit disposed within the fuse module housing;

a pair of terminal blades between which the fuse element unit is electrically connected, wherein each terminal blade comprises a pair of connection portions, a first fusible disconnect switch comprising a first pole terminal and a first housing;

a second fusible disconnect switch comprising a second pole terminal and a second housing, the first housing and the second housing arranged side-by-side; and a tie bar electrically connecting the first pole terminal and the second pole terminal, wherein the first housing comprises a receptacle to receive at least a portion of the fuse module, the receptacle comprising a fuse rejection feature defined in part by a lip, and wherein the first and second fusible disconnect switch is operable to selectively connect or disconnect a circuit path through the fuse module while the fuse module is installed in the receptacle.

2. The fusible disconnect switch assembly of claim 1, wherein the fuse module housing has a substantially square cuboid shape.

3. The fusible disconnect switch assembly of claim 1, wherein each terminal blade comprises a main portion from which the associated connection portions extend.

4. The fusible disconnect switch assembly of claim 1, wherein the connection portions extend through the fuse module housing.

5. The fusible disconnect switch assembly of claim 1, wherein the fuse element unit has a dual-element configuration.

6. The fusible disconnect switch assembly of claim 5, wherein the fuse element unit has at least one trigger mechanism and at least one perforated strip electrically connected to the trigger mechanism.

7. The fusible disconnect switch assembly of claim 1, wherein the fuse module has an ampacity rating of at least 1200 A.

8. The fusible disconnect switch assembly of claim 1, wherein the second switch housing comprises a receptacle defined in part by a lip, the lips of the first switch housing and the second switch housing arranged side-by-side to define a rib between the receptacles of the first and second fuse housings.

9. The fusible disconnect switch assembly of claim 1, wherein each of the first and second fusible disconnect switches comprises a pivotable actuator.

10. The fusible disconnect switch assembly of claim 1, wherein the first fusible disconnect switch comprises a third pole terminal and wherein the second fusible disconnect switch includes a fourth pole terminal, and the fusible disconnect switch assembly further comprising a second tie bar electrically connecting the third and fourth pole terminals together.

11. The fusible disconnect switch assembly of claim 1, wherein each of the first fusible disconnect switch and the second fusible disconnect switch comprises a blade slot, the blade slots being aligned to receive the fuse module that spans the fusible disconnect switches.

* * * * *